United States Patent [19]

Lakic

[11] Patent Number: 4,674,199

[45] Date of Patent: Jun. 23, 1987

[54] SHOE WITH INTERNAL FOOT WARMER

[76] Inventor: Nikola Lakic, 73-355 Guadalupe Ave. #M, Palm Desert, Calif. 92260

[21] Appl. No.: 849,024

[22] Filed: Apr. 7, 1986

[51] Int. Cl.[4] ..... A43B 7/02

[52] U.S. Cl. ..... 36/2.6; 219/211

[58] Field of Search ..... 36/2.6; 219/211, 527

[56] References Cited

U.S. PATENT DOCUMENTS

| | | | |
|---|---|---|---|
| 1,506,282 | 8/1924 | Barbieri | 219/211 X |
| 3,534,391 | 10/1970 | Bauer | 36/2.6 X |
| 3,977,093 | 8/1976 | Santroch | 36/2.6 |
| 4,507,877 | 4/1985 | Vaccari et al. | 36/2.6 |

FOREIGN PATENT DOCUMENTS

| | | | |
|---|---|---|---|
| 2365973 | 4/1978 | France | 36/2.6 |

*Primary Examiner*—James Kee Chi

*Attorney, Agent, or Firm*—Plante Strauss Vanderburgh

[57] ABSTRACT

There is disclosed a shoe with an internal warming mechanism which comprises an electrical resistance coil in the sole or upper coverings of the shoe, and with an electrical generation mechanism in the heel of the shoe which is driven by the up-and-down movements of the wearer's heel which accompanies normal activities such as skiing, hiking, etc. The electrical generator includes an armature mounted for rotational movement in a magnetic field and mechanically connected to a vertical post which is dependent on the undersurface of the heel portion of the inner sole of the shoe. The post is connected through a vertical spiral groove to a sleeve which is coupled with an escapement to a flywheel that is unidirectionally driven by the sleeve. The flywheel is coupled through a gear train to the armature of the electrical generator.

24 Claims, 13 Drawing Figures

SHOE WITH INTERNAL FOOT WARMER

BACKGROUND OF THE INVENTION

1. The Field of the Invention

This invention relates to electrically heated clothing and, in particular, to a shoe with an internal warming mechanism.

2. Brief Statement of the Prior Art

Electrically heated clothing such as gloves, mittens, etc., have been suggested by prior investigators. Usually, these suggestions have contemplated using a battery pack as the electrical power source which is connected through thermostats and/or switches to an electric resistance heating coil located in a glove or mitten.

These suggestions in the prior art have not been successfully commercialized since the electrical power requirements for the applications are substantial, exceeding that which can be supplied from a battery pack of acceptable size and portability. Additionally, batteries are very inefficient at low temperatures.

Although the feet and toes are the most sensitive to chilling and frostbite, these applications are not readily adaptable for warming of feet since the battery packs required are too cumbersome to be carried on the feet or lower limbs of the wearer with the result that lengthy power supply conductors must be used between the battery pack and the electrical resistance wiring.

The bulk, and low efficiency of batteries in cold weather are significant detractants to the use of electrically heated clothing in active outdoor activities such as skiing, skating, hiking, etc.

BRIEF STATEMENT OF THE INVENTION

This invention is a shoe with an internal warming mechanism. The warming mechanism includes an electrical resistance wiring or coil for converting electrical energy to thermal energy and this wiring is preferably encased in the subassembly of the sole and upper portion of the shoe.

The source of electrical energy for the mechanism includes an electrical power generator which is coupled to a mechanical transducer to convert movements of the wearer's foot into electrical energy. To this end, the heel of the shoe has a hollow cavity in which are positioned: an electrical generator, and lever means for translating the vertical movements of the wearer's heel into a mechanical force that drives the armature of the electrical generator. In a specific embodiment, the electric generator comprises an armature that is mounted for rotary movement within a magnetic field stator. The armature is mechanically coupled to a flywheel that is rotatably mounted in the heel cavity. The sole of the shoe has an internal heel plate which is coupled, on its undersurface, to a post that is received in a cylindrical sleeve. The cylindrical sleeve is rotatably mounted in the cavity of the heel and coupled by an escapement to the flywheel to translate up-and-down movements of the post to unidirectional rotary movement. The flywheel has peripheral gear teeth which engage driven gears on the input shafts of the armatures.

The invention provides significant advantages over the prior art. The electrical power required for the resistance wiring in the shoe is developed from electrical generation means carried within the heel of the shoe, thus eliminating lengthy wiring conductors and bulky and cumbersome battery packs. Since the electrical heating mechanism is entirely self-contained within the shoe, its use and application is simple and direct without requiring installation or attachment of external wires and the like. Instead, the user simply puts the shoe on, switches the warming mechanism and then performs normal activities, such as skiing.

DESCRIPTION OF THE DRAWINGS

The invention will be described with reference to the figures of which.

DESCRIPTION OF THE PREFERRED EMBODIMENT

Figure 1:
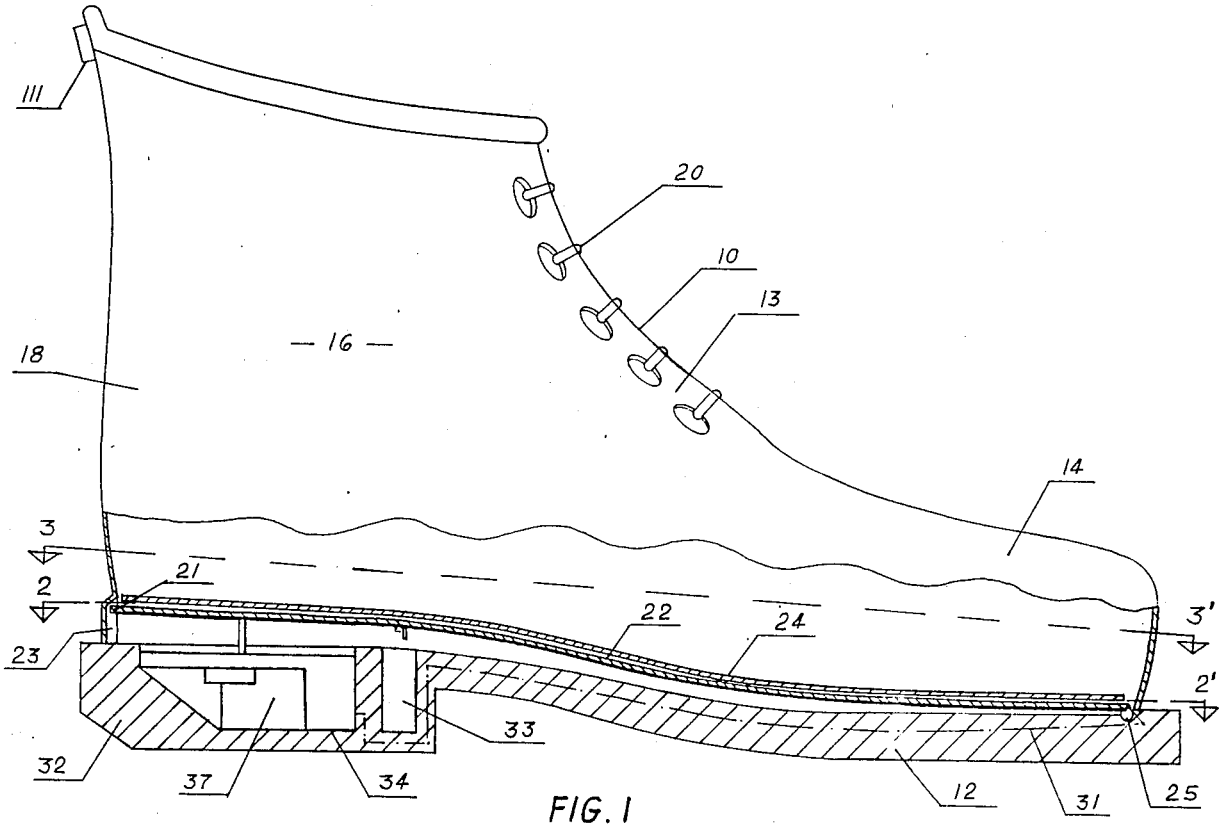
FIG. 1 is an elevational view, partially in cross section, of the shoe of the invention.
Figure 10:
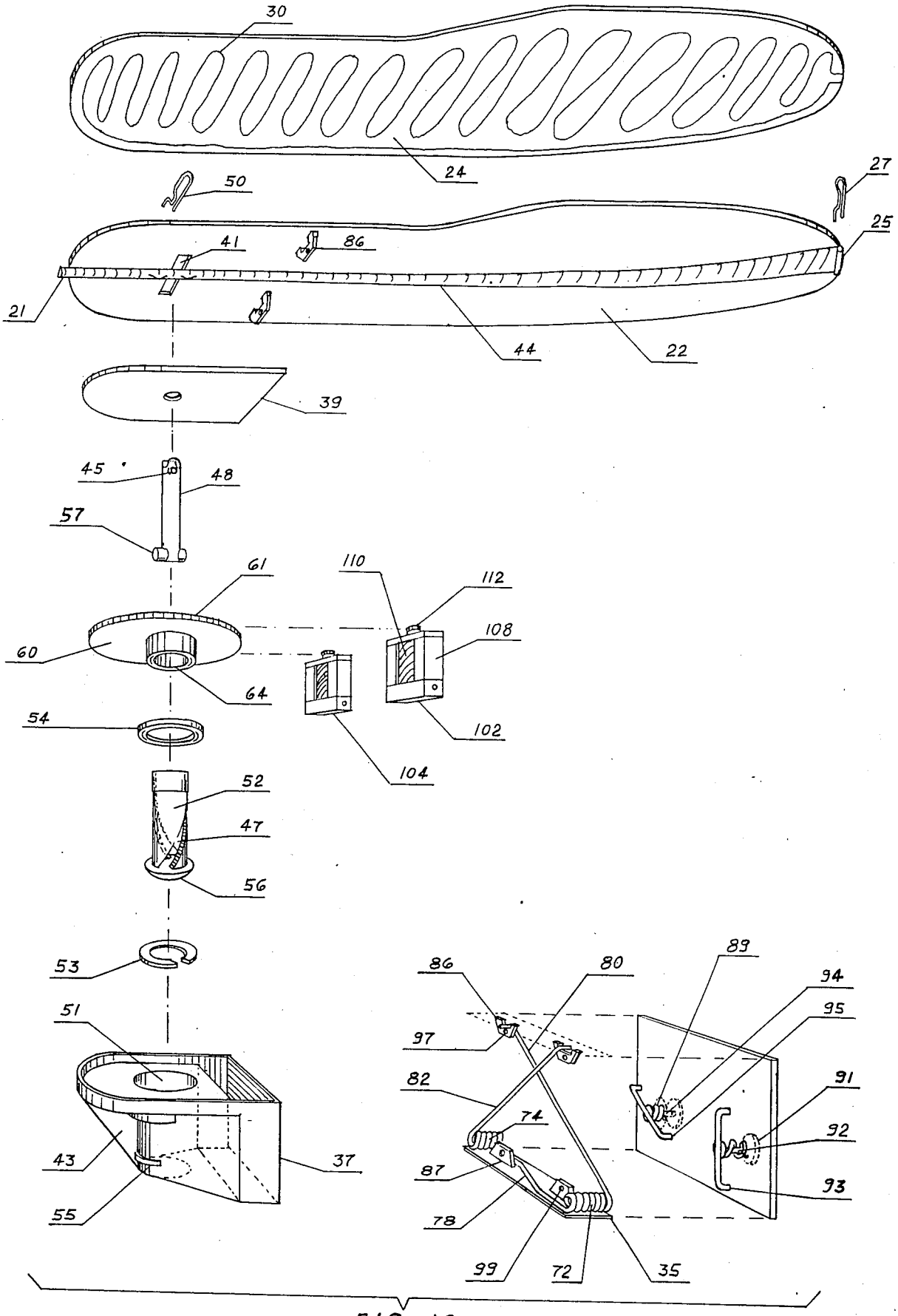
FIG. 10 is an exploded perspective view of the working elements of the invention.

The invention will be described with reference to FIG. 1, which illustrates the shoe of the invention in partial cross section. Externally, the shoe of the invention appears to be insignificantly different than a conventional shoe. The shoe 10 has a conventional sole 12, which is formed in a subassembly with an upper portion 13, with conventional assembly techniques, e.g., sewing, gluing, etc. The upper portion 13 includes a toe cover 14, side panels such as 16 and, preferably, an anklet portion 18, all of which are laced together with conventional lacing 20. The specific application illustrated is with reference to a ski boot, however the invention is equally applicable to any other foot apparel. Internally, the shoe has a sole plate 22 which is pivotally mounted in the toe by hinge 25 having a spring clip 27 (see FIG. 10) which serves as a hinge pin. At the heel end, sole plate 22 has a pin 21 which is received in a short vertical, centrally located channel 23, which limits lateral movement and serves as a vertical limit for travel of the pin 21.

Figure 2:
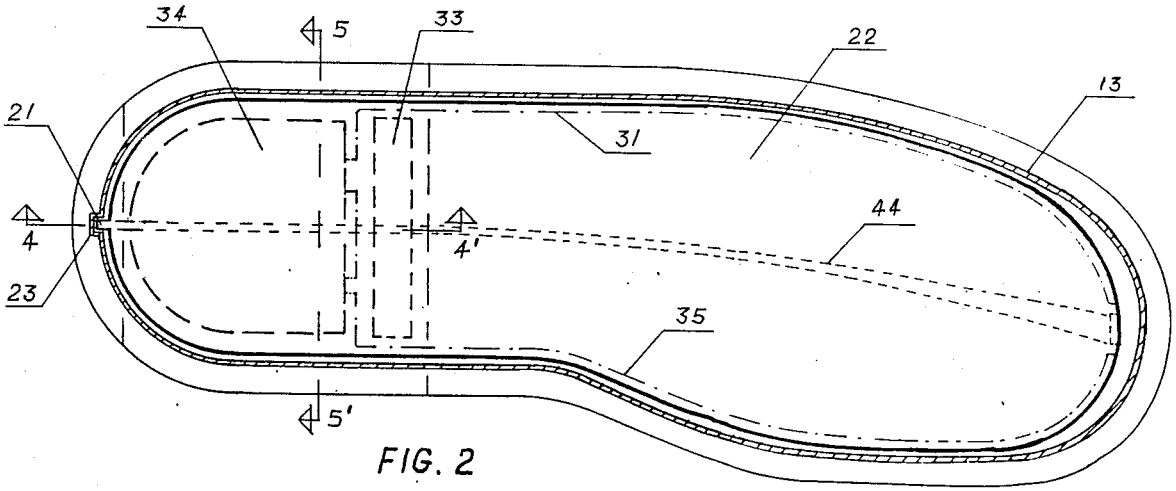
FIG. 2 is a view along line 2—2' of FIG. 1.

As shown in FIG. 2 the sole plate 22 of shoe 10 also has a conventional appearance, with a smooth cloth or leather cover lining the inside bottom of the shoe. The sole plate 22 extends over the heel. As shown in FIGS. 1 and 2, the heel 32 has a front cavity 33 and a central cavity 34. Cavity 34 receives a sealed housing 37 (not shown in cross-section) in which is mounted the electrical generation mechanism of the invention.

Figure 3:
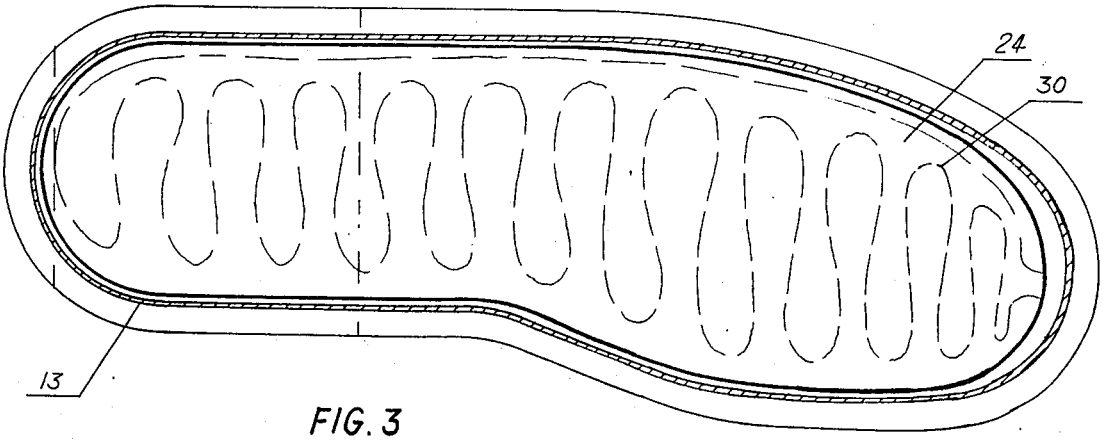
FIG. 3 is a view along line 3—3' of FIG. 1.

Referring now to FIG. 3, the sole plate 22 has, encased within it and beneath its outer cover, an electrical resistance heater 24 formed of serpentine windings of a small diameter electrical conductor 30. The various portions of the upper of the shoe 10 could, besides, or alternatively, contain such electrical resistance element. Electrical conductors 31 and 35 extend from heel 32, along sole 12 from the electrical generation cavity 34 to the terminals of heater 24.

Figure 4:
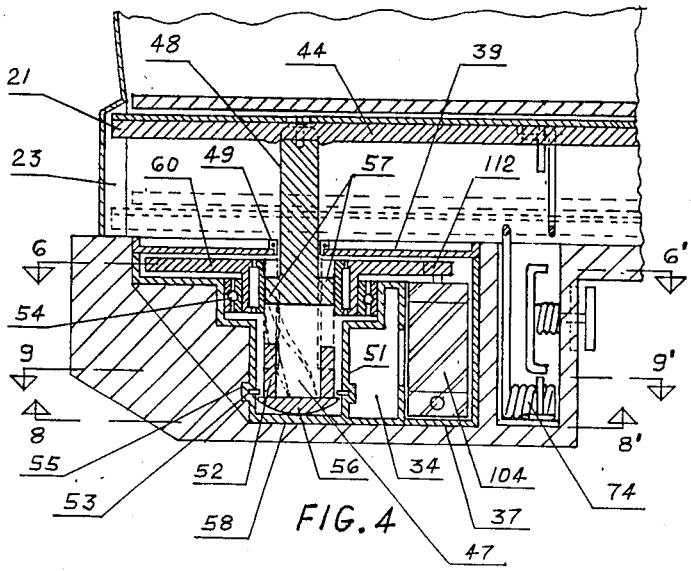
FIG. 4 is a view along line 4—4' of FIGS. 2 and 6.
Figure 5:
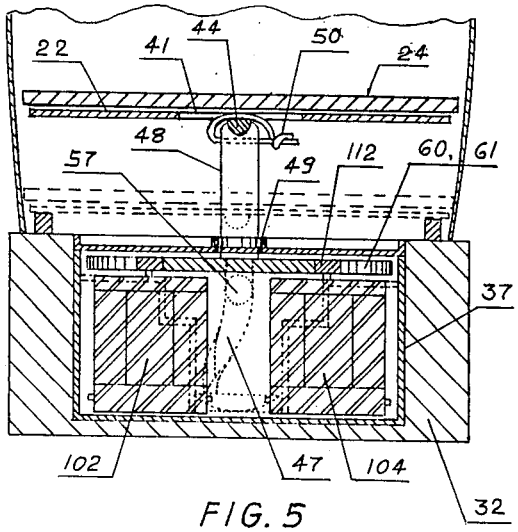
FIG. 5 is a view along line 5—5' of FIG. 2.
Figure 6:
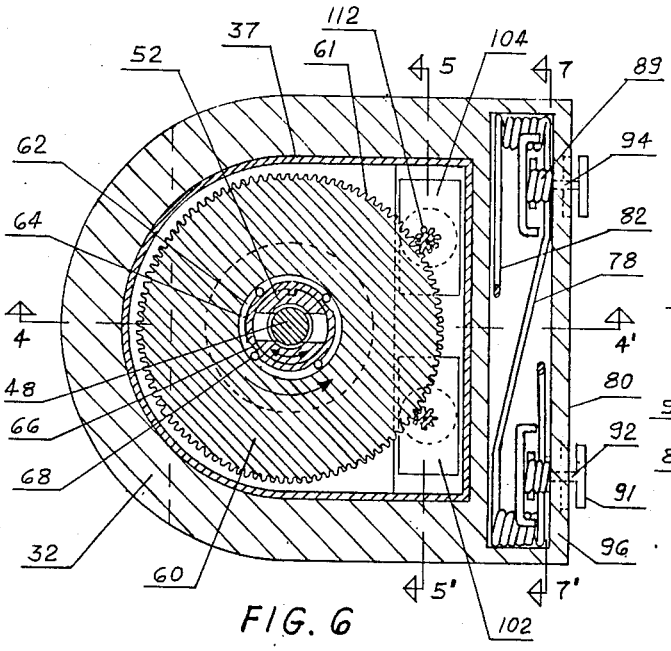
FIG. 6 is a view along line 6—6' of FIG. 4.
Figure 7:
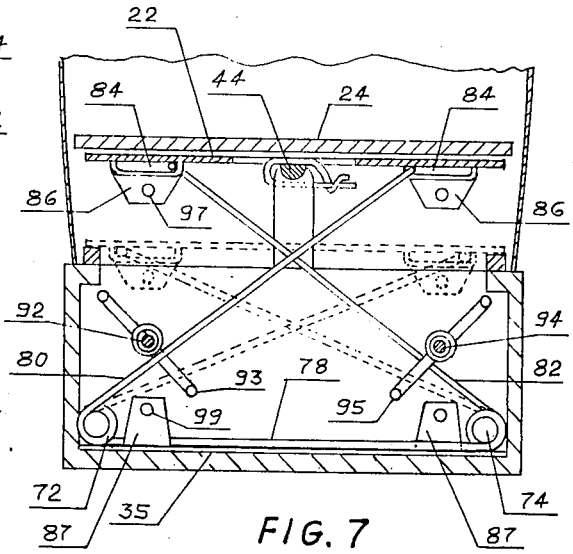
FIG. 7 is a view along line 7—7' of FIG. 6.

As shown in FIG. 4, which is an elevational cross sectional view along line 4—4' of FIGS. 2 and 6, the heel 32 has an interior cavity 34 which receives an enclosed housing 37 which contains the electrical power generator means. The cavity 34 lies beneath the heel portion of sole plate 22. As shown in FIG. 5, sole plate 22 has a slot 41 and supports, on its under surface, a longitudinal rib 44. The longitudinal rib 44 is received in an arcuate recess on the upper end of post 48 and this post is coupled to the bar by a suitable spring clip 50 which is received in bore 45 of post 48, thereby permitting rocking of the sole plate 22 on post 48.

The post 48 is received in sleeve 52 that is rotatably mounted in an interior cylindrical recess 51 of the housing 37. To this end, an annular bearing 54 (either a roller or ball bearing) is provided near the upper end of sleeve and the lower end of the sleeve has a arcuately rounded bearing end 56 which is received against the bottom surface 58 of the housing 37 which is received in the heel cavity 34. The post 48 is retained in recess 51 by spring clip 53 (see FIG. 10) which expands into annular chamber 55 of housing 37.

The housing 37 also rotatably receives flywheel 60 which is mounted on the upper end of the sleeve 52. The flywheel 60 has a central aperture 62 (see FIG. 6) which receives a radial cam ring 64 which is fixedly secured to the upper end of the sleeve 52. As shown in FIG. 6, the cam ring 64 has a plurality of inset notches 66 which serve as receptacles in which are mounted a like plurality of cam rollers 68. The radial cam ring 64 and its assembly in the flywheel 60 as thus described provides an escape mechanism for the translation of rotary movement shown by the double arrowhead line from sleeve 52 to the flywheel 60. In the illustrated embodiment, clockwise rotation of the sleve 52 will not be translated to the surrounding flywheel 60 as the rollers 68 simply rotate in their receptacles, notches 66. Counter clockwise rotation of the cam ring 64, however, will move the inclined cam surfaces of notches 66 toward the rollers 68, wedging the rollers 68 firmly between the cam ring 64 and the surrounding flywheel 60, causing movement of the flywheel (in the direction shown by the single arrowhead line) with movement of the sleeve.

Up-and-down, reciprocal movement of the post 48 is translated to rotary movement of the sleeve by the helical groove 47 which is milled in the interior wall of the sleeve and which receives a pin 57 that is fixedly secured in the post 48. If desired, suitable bearings (not shown) can be placed on pin 57.

The post 48 is driven downwardly by the downward movement of the heel of the wearer, which is transferred through the sole plate 22, rotating sleeve 52 and its interlocked flywheel 60. Upward movement of the post and sole plate, however, reverses the rotation of the sleeve 52 but does not effect relative rotation of the flywheel 60.

Positive lift means for the internal sole plate 22 is provided by the resilient torsion spring subassembly located in heel cavity 33. The spring subassembly includes a pair of torsion coils 72 and 74, of a resilient spring wire and having dependent arms 78, 80 and 82 extending from opposite ends of each coil. Arm 78 rests against the bottom plate 35 in the cavity 33 within the heel which receives the resilient spring subassembly. The upper arms 80 and 82 of the spring subassembly are received in slots 84 of brackets 86 that are fixedly secured to the under surface of the interior sole plate 22. In this fashion, the sole plate 22 can move downwardly under applied pressure from the weight of the wearer, tensioning the torsion springs so that when the wearer's weight is released, the torsion springs lift the sole plate upwardly, restoring it for the succeeding downward flexing under the weight of the wearer. Although the resilient torsion springs could be mounted in cavity 34 of the heel, which receives the electrical generation mechanism, it is preferred to locate this spring subassembly 70 in a forwardly located, second interior cavity 33.

The mechanism is provided with suitable lock means to disengage the electrical generation mechanism. This comprises latch pins 92 and 94 which are located in the forward heel cavity 33 and which project through the forward face 96 of the heel. A small wheel or button 91 is fixedly mounted on each pin 92 and 94. Although not shown, a suitable seal such as an O-ring, surrounds each pin, sealing it in the forward face 96 of the heel. The latch pins include dependent prongs 93 and 95 which can be seated in latch pin apertures 97 and 99, in brackets 86 and 87, respectively when the heel plate is depressed. Brackets 87 are secured to the bottom plate 35 so that the entire mechanism can be locked together with the spring subassembly 70 in its compressed condition. The latch pins 92 and 94 each have tension springs 89 to biase the pins outwardly from cavity 33.

Figure 11:
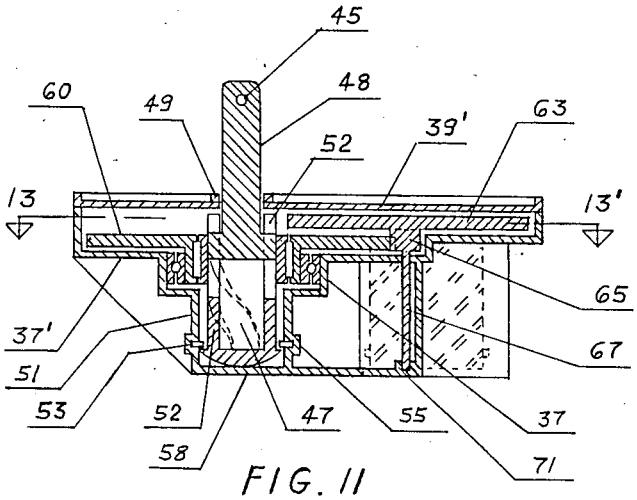
FIG. 11 is an elevational sectional view of another embodiment of the invention.
Figure 12:
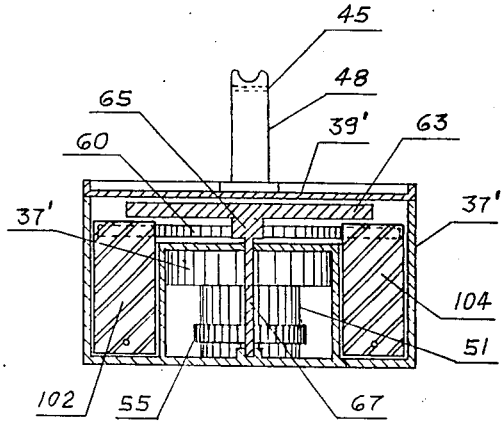
FIG. 12 is a view along line 12—12' of FIG. 11.
Figure 13:
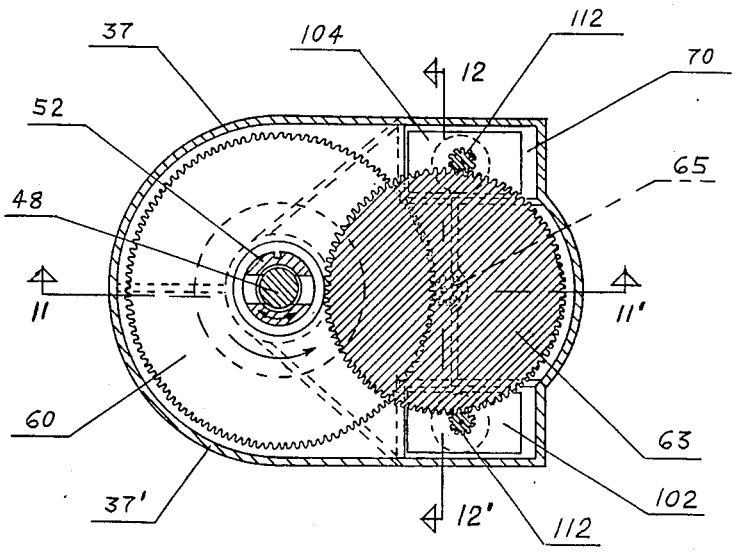
FIG. 13 is a view along line 13—13' of FIG. 11.

The embodiment shown in FIGS. 11–13 increases the rotational speed of the armatures in response to up-and-down movements of the wearer's heel over that obtained in the embodiment of FIGS. 1–10. High gear ratios from 15 to about 250, preferably from about 20 to 150, can be used as there is ample force or rotational torque which is applied to the flywheel 60 by post 48 which is responsive to the weight of the wearer. These high gear ratios provide very favorable multiplication of the rotational speed of the armatures, e.g., for every rotation of flywheel 60, the spur gears 112 rotate from 15 to 250, preferably 20 to 150 times, as determined by the gear ratio in the drive train.

The invention includes suitable electrical conductors, generally shown as wires 31 and 35 which extend from each of the terminals of the electrical generators to the electrical resistance heater 24 shown in FIG. 3. These conductors place the electrical generators 102 and 104 in series connection with the electrical resistance heating element 24.

If desired, a suitable connector receptacle 111 (see FIGURE 1) can be positioned along the top edge of the upper of the boot and can be connected in circuit with the electrical generation mechanism of the invention. This permits the user to connect with a simple two-pronged connector and cable for tapping of electrical power which can be directed to other wearing apparel, e.g., electrically heated gloves, mittens, jacket, earmuffs and the like.

Figure 8:
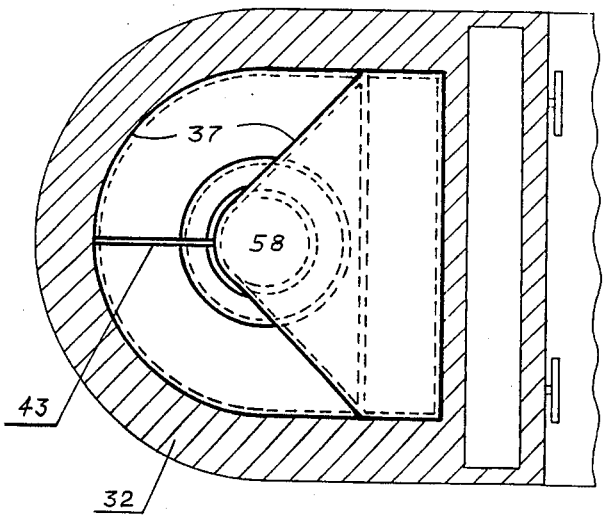
FIG. 8 is a view along line 8—8' of FIG. 4.
Figure 9:
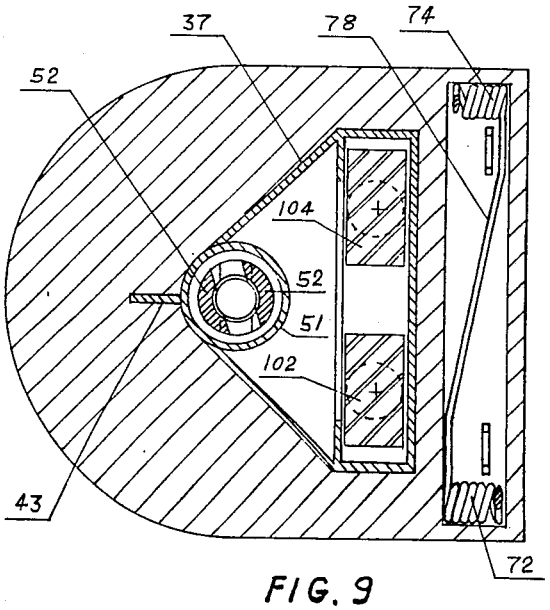
FIG. 9 is a view along line 9—9' of FIG. 4.

The bottom of housing 37 is shown in FIG. 8 with a trapezoidal shape. The entire housing can be sealed with a cover plate 39 (see FIG. 4) which has a single aperture that receives post 48. A seal ring 49 is placed about post 48 to maintain the interior of housing 37 sealed against dirt and moisture.. The housing can be reinforced with a stiffening rib 43 which extends along its rear wall, externally of the housing; see also FIG. 9.

As previously mentioned, the invention includes suitable electrical generators. The illustrated embodiment has two small electrical generators 102 and 104, each located in opposite, forward corners of the interior cavity 34 of the heel. Each of the electrical generators 102 and 104 includes a permanent magnet 108 and a rotatably mounted armature 110 having an internal coil. The armature is rotatably mounted within the surrounding magnets 108. The armatures 110 have a conventional shaft on which is fixedly secured a spur gear 112. The spur gear of each of the generators is connected to the flywheel by the gear teeth 61 disposed on the periphery of the flywheel 60. Alternatively a belt of sprocket chain linkage could also be used.

Referring now to FIGS. 11–13, another embodiment of the invention is shown in which additional gears are provided in the gear train between the flywheel and the spur gears 112. As shown in FIG. 13, the housing 37' is modified slightly from that shouwn in FIGS. 1–10 to provide a forward compartment 70 which receives a multiplication gear 63 that is mounted on shaft 67 which also supports spur gear 65. The shaft 67 is rotatably received in a bearing (not shown) at its upper end and its lower end resting in a bearing 71 on the bottom 58 of housing 37'. The two electrical generators 102 and 104 are mounted on opposite sides of gear 63 with their spur gears 112 engaged with the peripheral teeth of gear 63. The small spur gear 65 is engaged with the peripheral teeth of gear 60.

The invention provides significant advantage over the prior art. Bulky and cumbersome battery packs are eliminated, together with marginal performance under freezing weather conditions. The very repetitive and forceful weight applications of the wearer on the heel of each shoe is effectively transformed into electrical energy which warms the toes and feet of the wearer. Additionally, the spring resistance and the resistance of the electrical generators provides a resilient, shock-absorbing action, avoiding heel bruises and fatigue to the wearer. The shoes or boots of the invention can be used without any particular instruction or changes in the habits or performance of the wearer. The mechanism does not add significantly to the overall weight of the shoe and, since it is entirely self-contained within the shoe and heel, no compromise in structure is required. Although the electrical generators are relatively small, they are highly effective in generating sufficient electrical power to maintain the toes and feet of the wearer comfortable even in sub-zero climates. This effectiveness increases significantly with increasing physical activity by the wearer.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A shoe with internal warming means comprising:

a. a shoe subassembly of an external sole plate and an upper foot covering coextensive with, and extending above said external sole plate;

b. a heel fixedly secured on the rear undersurface of said external sole plate and having an internal cavity therein;

c. an internal sole plate pivotally mounted on a hinge at a forward location in said shoe for up and down movement above said heel;

d. at least one electrical resistance heater received within said shoe subassembly;

e. electrical power generation means mounted within said cavity of said heel with electrical conductor leads connecting said power generation means in series to said electrical resistance heater;

f. lever means received in said cavity of said heel and operatively mounted on the internal sole plate and connected in a driving relationship to said power generation means whereby vertical movement of said internal sole plate is effective to generate electrical power to effect warming of said shoe by said electrical resistance heater.

2. The shoe of claim 1 including a post on the undersurface of said internal sole plate and an upright housing receiving said post whereby movement of said sole plate effects vertical displacement of said post in said housing.

3. The shoe of claim 2 wherein said housing is a cylindrical cavity with a sleeve rotatably received therein and interconnecting means on each of said post and sleeve whereby vertical displacement of said post effects rotation of said sleeve.

4. The shoe of claim 3 wherein said sleeve has a helical groove along its internal wall and said post has a protruding pin which is received in said helical groove.

5. The shoe of claim 4 including bearing means received in said cylindrical cavity for vertical and lateral bearing support of said sleeve.

6. The shoe of claim 5 wherein said sleeve supports a horizontal flywheel with interlocking means between said flywheel and sleeve whereby rotation of said sleeve effects rotational movement of said flywheel, and gear means on said flywheel interconnecting said flywheel to said electrical power generation means.

7. The shoe of claim 6 wherein said electrical power generation means includes a stator and an armature rotatably mounted therin on a power input shaft, with gear means on said power input shaft interconnected to said gear means of said flywheel.

8. The shoe of claim 7 including two said electrical power generation means, each with its own power input shaft which in interconnected in said gear means of said flywheel.

9. The shoe of claim 8 wherein said gear means on said flywheel comprise a plurality of gear teeth disposed about the periphery of said flywheel.

10. The shoe of claim 9 including escapement means mounted on said post and operatively connected to said flywheel, whereby up and down displacements of said post are translated to unidirectional rotational movement of said flywheel.

11. The shoe of claim 10 wherein said escapement means comprise a cam wheel fixedly secured to the outer wall of said sleeve and having a plurality of radial cam grooves disposed about is peripheral surface, a cylindrical cavity centrally located in said flywheel, and a like plurality of rollers, one each received in each of said radial cam grooves, whereby said radial cam is interlocked to said flywheel for rotation in one direction, and is free for rotation within said flyweel in the other direction.

12. The shoe of claim 1 including resilient means biasing said internal sole plate upwardly in a vertical direction.

13. The shoe of claim 12 wherein said resilient means comprise at least one spring means received in said cavity of said heel and biased between the lower inside surface of said heel cavity and the undersurface of said internal sole plate.

14. The shoe of claim 13 wherein said spring means comprises a torsion spring.

15. The shoe of claim 14 wherein said torsion spring has a coiled winding of a resilient spring wire with first and second, arms dependent from opposite ends of said coil winding.

16. The shoe of claim 15 including two said torsion springs, each with its arms resilient captured between the bottom wall of said heel cavity and the undersurface of said internal heel plate.

17. The shoe of claim 16 including bracket means slidably receiving the end of at least one of said torsion spring arms.

18. The shoe of claim 17 wherein said heel has a second cavity located in front of said internal heel cavity and wherein said resilient torsion springs are mounted in said second cavity.

19. The shoe of claim 1 wherein said post is linked to the undersurface of said internal sole plate with pivotal attachment means.

20. The shoe of claim 19 wherein said pivotal attachment means includes a lateral rail on the undersurface of said internal heel plate with spring clip means interconnecting said lateral rail to the upper end of said post.

21. The shoe of claim 1 wherein said internal cavity in said heel has a width which is greater than its height, and including a flywheel having a diameter substantially equal to the width of said cavity and horizontally and rotatably mounted therein.

22. The shoe of claim 1 wherein said housing is lined with a housing sealed with a cover having an aperture which receives said post.

23. The shoe of claim 22 wherein said sealed housing has an upright cylindrical recess which receives said post.

24. The shoe of claim 21 including at least two compound gears in driving relationship between said post and said electrical generation means.

* * * * *